US011453564B2

(12) United States Patent
Peterlini

(10) Patent No.: US 11,453,564 B2
(45) Date of Patent: Sep. 27, 2022

(54) APPARATUS FOR SUPPLYING A COIL-LIKE PADDING PRODUCT FOR PACKAGING PURPOSES

(71) Applicant: Storopack Hans Reichenecker GMBH, Metzingen (DE)

(72) Inventor: Jacky Peterlini, Annecy-le-Vieux (FR)

(73) Assignee: Storopack Hans Reichenecker GMBH, Metzingen (DE)

( * ) Notice: Subject to any disclaimer, the term of this patent is extended or adjusted under 35 U.S.C. 154(b) by 0 days.

(21) Appl. No.: 16/622,330

(22) PCT Filed: Jun. 6, 2018

(86) PCT No.: PCT/EP2018/064899
§ 371 (c)(1),
(2) Date: Dec. 13, 2019

(87) PCT Pub. No.: WO2018/234040
PCT Pub. Date: Dec. 27, 2018

(65) Prior Publication Data

US 2020/0198914 A1 Jun. 25, 2020

(30) Foreign Application Priority Data

Jun. 20, 2017 (DE) ..... 10 2017 113 532.4

(51) Int. Cl.
*B65H 18/26* (2006.01)
*B65H 18/28* (2006.01)

(52) U.S. Cl.
CPC ..... *B65H 18/26* (2013.01); *B65H 18/28* (2013.01)

(58) Field of Classification Search
CPC .. B65H 18/26; B65H 18/28; B65H 2701/177; B65H 2801/63; B65H 18/22;
(Continued)

(56) References Cited

U.S. PATENT DOCUMENTS 2,057,191 A * 10/1936 Huffine ..... D01G 27/00 242/535.1
3,315,908 A * 4/1967 Wetzler ..... B65H 18/22 242/535.1
(Continued)

FOREIGN PATENT DOCUMENTS

DE 910754 C 5/1954
DE 2917769 A1 11/1979
(Continued)

OTHER PUBLICATIONS

DE 10 2017 113 532.4 Patent Application Office Action dated Jan. 8, 2018.
(Continued)

*Primary Examiner* — William A. Rivera
(74) *Attorney, Agent, or Firm* — Wood Herron & Evans LLP

(57) ABSTRACT

An apparatus for supplying a coil-like padding product for packaging purposes comprises a supply device for supplying a web-type padding material and also a rolling-up apparatus, which rolls up the web-type padding material to form the coil-like padding product. It is proposed that the rolling-up apparatus should comprise a flexible delimiting means, which can form an at least partially curved delimiting wall of an at least temporarily present rolling-up space, of which the extent is preferably alterable and which has an inlet for the web-type padding material, it being possible for the web-type padding material to enter into the rolling-up space through said inlet, wherein the web-type padding material is guided by the at least partially curved delimiting wall, this resulting in the formation of the coil-like padding product.

13 Claims, 2 Drawing Sheets

(58) Field of Classification Search
CPC ..... B65H 18/023; B31D 2205/0047; B31D 2205/007; B31D 2205/0082; B31D 5/006
See application file for complete search history.

(56) References Cited

U.S. PATENT DOCUMENTS 5,011,093 A * 4/1991 Mayer ..... B65H 19/2276 242/527.5
5,425,512 A * 6/1995 Bichot ..... B65B 63/024 242/541.3
5,655,729 A * 8/1997 Casimaty ..... B65H 18/22 242/535.1
6,109,560 A * 8/2000 Siegel ..... B65B 63/024 100/88
6,123,284 A * 9/2000 Bichot ..... B65B 63/024 242/541.2
6,887,343 B2 * 5/2005 Schukar ..... B01D 29/012 156/195
7,100,862 B2 * 9/2006 Skarzenski ..... B30B 9/3082 242/541.3
8,960,587 B2 * 2/2015 Akpan ..... B65H 18/22 242/535.1
2008/0098699 A1 5/2008 Cheich et al.

FOREIGN PATENT DOCUMENTS

DE 3441197 A1 5/1986
DE 19817870 A1 11/1999
EP 1027214 B1 12/2003
EP 3115324 A1 1/2017
EP 3159291 A1 4/2017
WO 9906619 A1 2/1999
WO 2014085465 A1 6/2014

OTHER PUBLICATIONS

PCT/EP2018/064899 Written Opinion, International Filing Date—Jun. 6, 2018.

* cited by examiner

APPARATUS FOR SUPPLYING A COIL-LIKE PADDING PRODUCT FOR PACKAGING PURPOSES

The invention relates to an apparatus for supplying a coil-like padding product for packaging purposes according to the preamble of claim 1.

In principle, transforming a web-type starting material, for example paper, into a web-type padding material by means of machine crumpling is already known. Rolling up this crumpled web-type padding material into a coil-like or spiral-like padding product is also known. This coil-like padding product has the ability to carry even heavy objects. To produce the coil-like padding product, the web-type padding material is usually coiled or rolled up on a rotating reel which is removed again after rolling up. An example of this is specified in EP 1 027 214 B1.

The object of the present invention is to provide an apparatus of the type mentioned at the outset which works reliably and simply and with which it is possible to produce a tightly packed coil-like padding product.

This object is achieved by an apparatus having the features of claim 1. Advantageous developments of the invention are specified in the dependent claims. In addition, features essential to the invention can be found in the following description and in the attached drawings. These features may be essential to the invention, both alone and in different combinations, without this being explicitly stated in detail.

The apparatus according to the invention for supplying a coil-like padding product for packaging purposes firstly comprises a supply device for supplying a web-type padding material. This may be, for example, either a storage means in which the web-type padding material is stored, or the outlet of an apparatus which produces the web-type padding material by means of reshaping, for example by means of crumpling, a planar web-type starting material, for example a flat paper web.

Furthermore, the apparatus according to the invention comprises a rolling-up apparatus which rolls up the web-type padding material to form the coil-like padding product. An essential element of the invention is that this rolling-up apparatus has no reel and instead comprises a flexible delimiting means which can form a generally curved delimiting wall of an at least temporarily present rolling-up space of which the extent is preferably alterable and which has an inlet for the web-type padding material through which the web-type padding material can enter into the rolling-up space. The rolling-up space is thus temporarily available insofar as it first begins to emerge when the web-type padding material meets the flexible delimiting means held under a certain tension and pushes said means in.

Rolling up the web-type padding material to form the coil-like padding product is thus made possible without the reel, which is required in conventional apparatuses, being required. Instead, the web-type padding material is forced radially inward from radially outward by the flexible delimiting means into a "curve" so that it can be rolled up. The web-type padding material is thus guided by the generally curved delimiting wall onto an inwardly curved track which results in the formation of the coil-like padding product.

Since a reel, which must be removed after rolling up, or any other core is no longer required in order to roll up the web-type padding material, the coil-like padding product produced in this way also has a desired density in the center thereof and therefore also has desired padding properties in the center. On account of the fact that the extent of the rolling-up space is preferably alterable, it has been taken into account that the diameter of the coil-like padding product can increase continuously during the rolling-up process. A blockage of the rolling-up space is thereby prevented. In addition, padding products having different diameters can thus be produced in a simple way.

In principle, it is conceivable for the coil-like padding product to be produced by rolling up from the inside to the outside, as a result of which the diameter of the coil-like padding product increases during rolling up. However, it is also conceivable for the coil-like padding product to be produced by rolling up from the outside to the inside, whereby the outer diameter of the coil-like padding product is fixed at the beginning, and whereby the initially empty space is filled up from the outside to the inside during rolling up by the front end of the web-type padding material being pushed forward. In this case, the rolling-up space could be formed for example by a housing having helical passages.

In a first development of the apparatus according to the invention, the flexible delimiting means is movable in a rolling-up direction. The at least partially curved delimiting wall formed by the flexible delimiting means therefore co-rotates in the rolling-up direction, thereby assisting the rolling-up process and thus improving the operational reliability of the apparatus according to the invention.

It is particularly preferable for the flexible delimiting means to be made from an elastic material. As a result, the variability of the extent of the rolling-up space and also a certain pretension can be implemented in a very simple manner.

It is also proposed that the flexible delimiting means comprises a strip material and/or a chain-like structure. Such a strip material or such a chain-like structure can very easily form a surface which is planar when viewed in the width direction of the rolling-up space or which is concave when viewed from the rolling-up space and which reliably guides the web-type padding material during the rolling-up process, as a result of which the operational reliability is also improved.

It is also advantageous if the rolling-up space, when viewed from the side, has a generally substantially circular cross section. This corresponds ideally to the "natural" outer contour of the coil-like padding product.

A particularly preferred development of the apparatus according to the invention further comprises: a continuous strip which extends around a plurality of deflecting means, at least one of which is tensible, such that it holds the continuous strip at least temporarily under tension; and a drive which drives the continuous strip in one direction; the inlet into the rolling-up space being formed between two deflecting means such that, during operation, the web-type padding material is guided through said inlet transversely to the continuous strip, thus in a feed direction of the web-type padding material, and as a result the continuous strip is pushed in in the feed direction of the web-type padding material, and the delimiting means which forms a delimiting wall of the rolling-up space is formed by the pushed-in continuous strip.

As a result, a specific apparatus is defined which operates very flexibly and enables a high throughput and by means of which a large amount of coil-like padding products can be produced within a certain unit of time. In addition, the apparatus according to the invention is technically and mechanically very simple to construct and in this respect very inexpensive. It should be noted at this point that the term "continuous strip" is to be understood very broadly. In this respect, this term includes not only a conventional strip, i.e. a flat, flexible part made from plastics material and/or a textile for example, but also for example a link chain made from metal and/or plastics material for example.

In a development thereof, it is proposed that at least one of the deflecting means, preferably all the deflecting means, comprises or comprise a rotatably mounted roller. This leads to less friction, secure guidance and thus to a more efficient apparatus.

It is also proposed that the rolling-up space can be opened and/or destroyed in order to remove the coil-like padding product. This allows for an easy removal of the produced coil-like padding product from the rolling-up space. It should be noted at this point that the term "can be destroyed" is to be understood very broadly. In conjunction with the above-described apparatus having the continuous strip, the rolling-up space first begins to be formed when a web-type padding material meets the continuous strip and pushes said strip in. If the produced coil-like padding product is removed, the continuous strip becomes taught again, causing the rolling-up space to cease to exist, and in this respect is therefore "destroyed".

This can be implemented specifically and in a very simple manner in that one of the two deflecting means forming the inlet into the rolling-up space is displaceably mounted such that an opening extent of the inlet can be increased in order to remove the coil-like padding product.

In the proposed apparatus according to the invention comprising the continuous strip, it is proposed, in order to simply and reliably ensure that the continuous strip is constantly under a certain pretension, that the tensible deflecting means is guided linearly and comprises a pretensioning device in the form of a spring or a weight.

In the following, an embodiment of the invention will be explained with reference to the accompanying drawings, in which.

An apparatus for supplying a coil-like padding product for packaging purposes has reference sign 10 throughout FIG. 1-4. The apparatus comprises a supply device 12 for supplying a web-type padding material 14. By way of example, the supply device 12 may be a reshaping device which produces the web-type padding material from a flat, planar strip of paper by means of reshaping, for example by means of crumpling. In contrast to this flat, planar strip of paper, the web-type padding material 14 thus already has a 3-dimensional structure.

Figure 1:
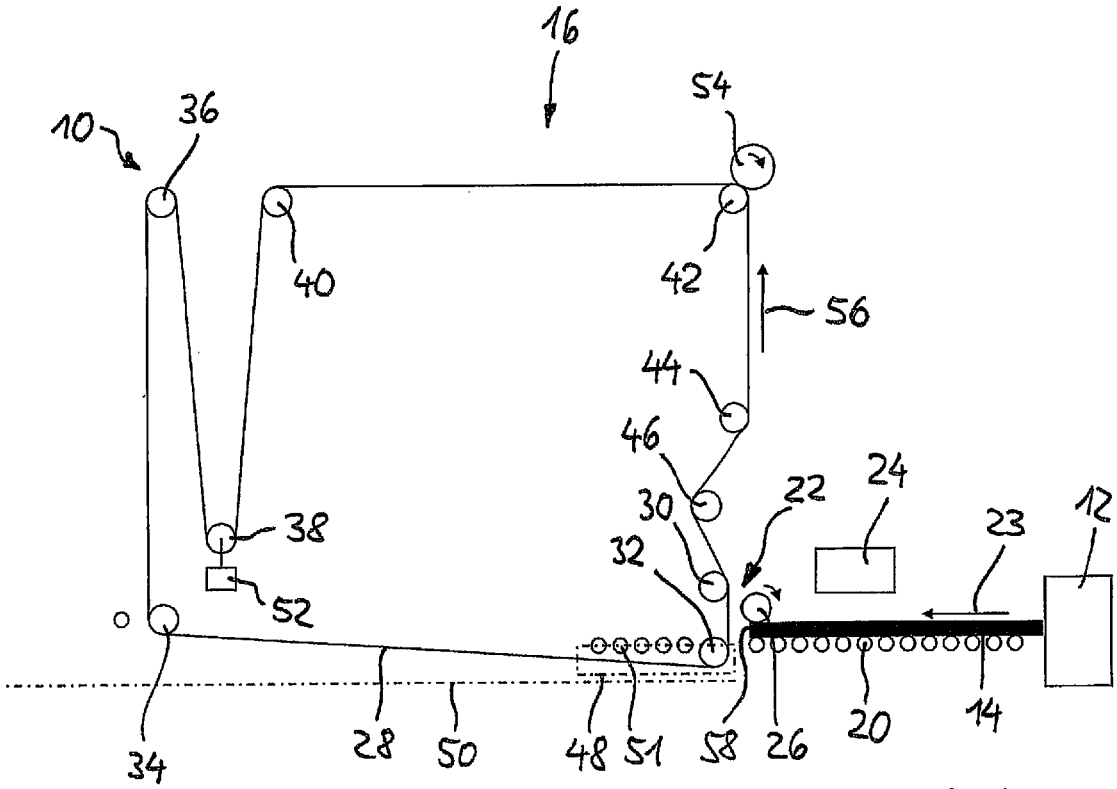
FIG. 1 is a schematic side view of an apparatus for supplying a coil-like padding product for packaging purposes at a first point in time during production of the padding product.
Figure 2:
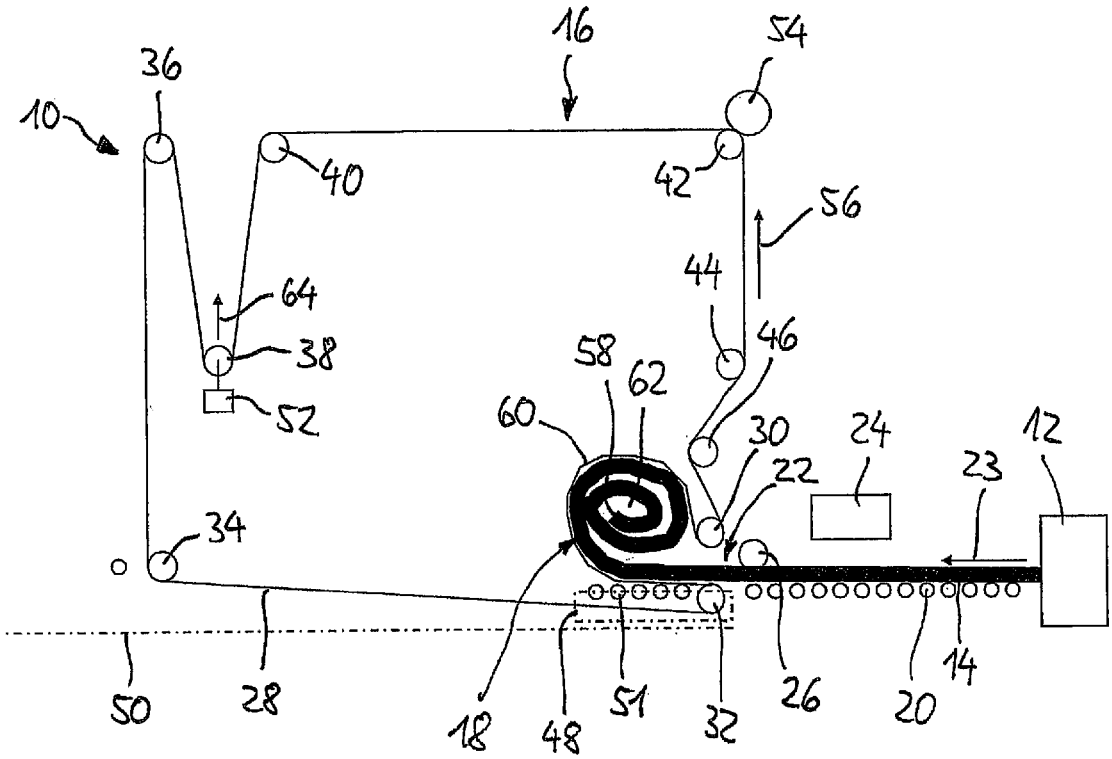
FIG. 2 is a view similar to FIG. 1 at a second point in time.
Figure 3:
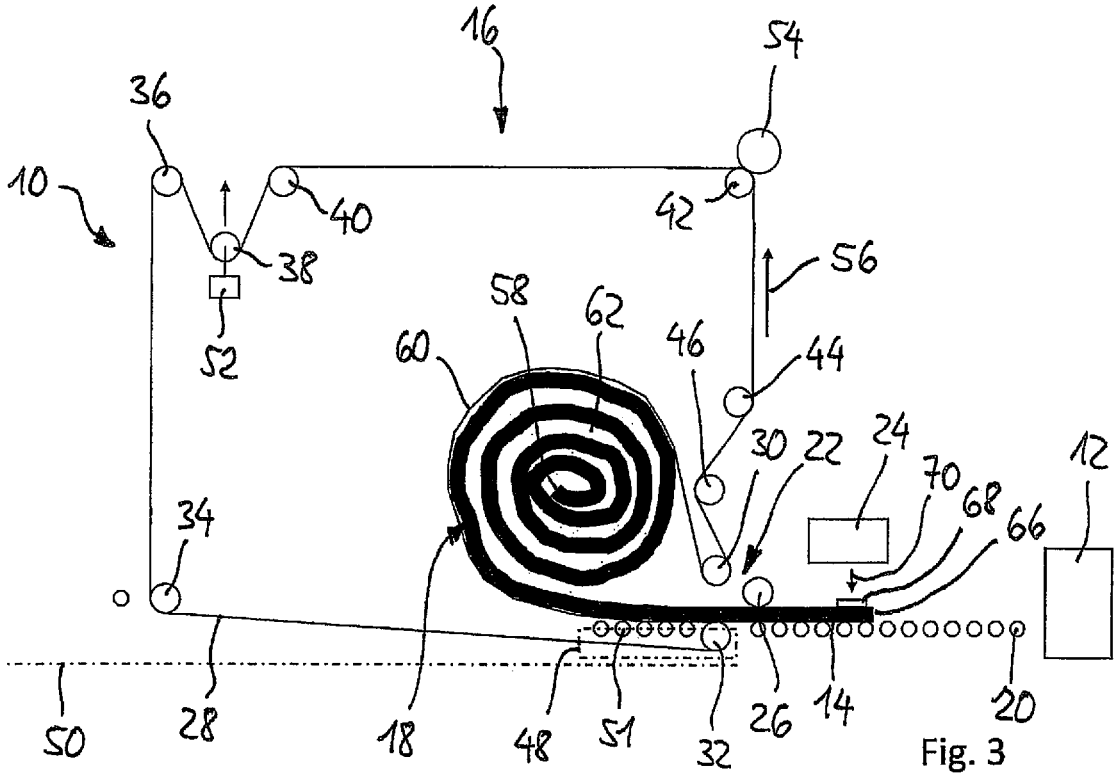
FIG. 3 is a view similar to FIG. 1 at a third point in time.
Figure 4:
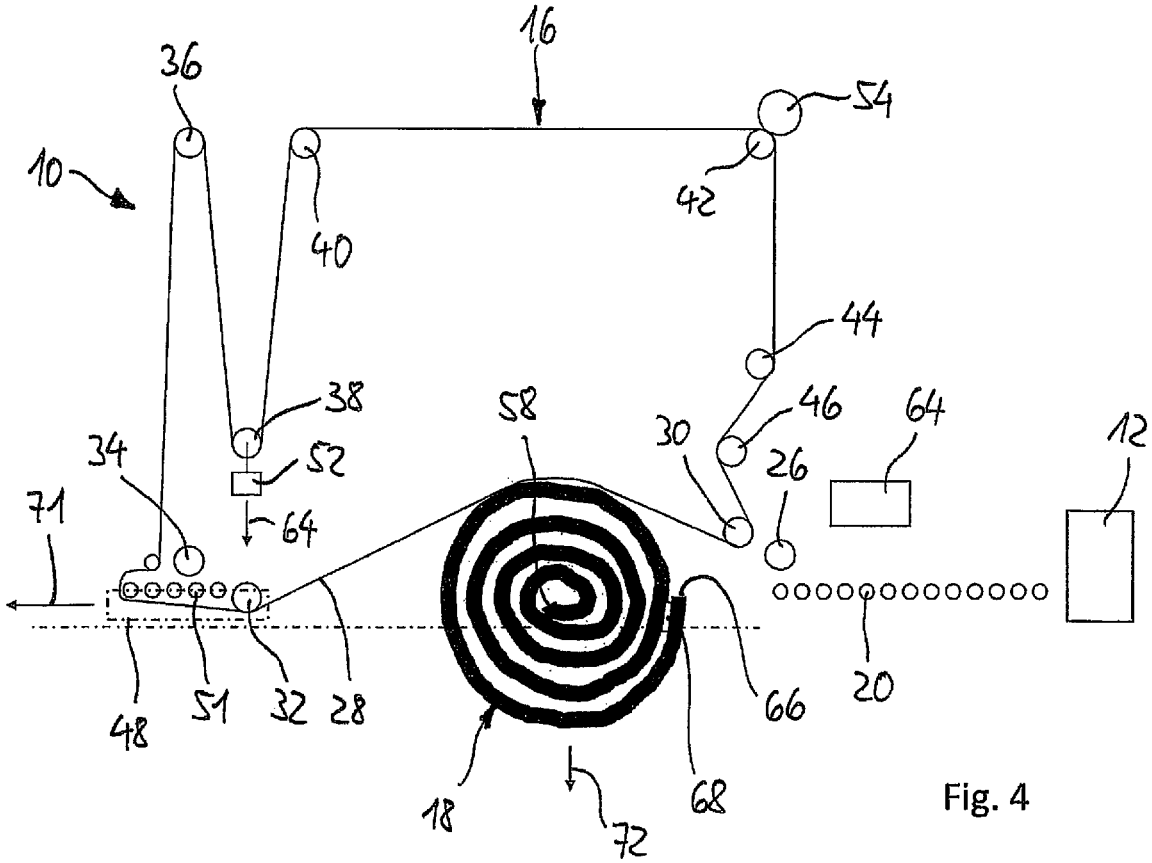
FIG. 4 is a view similar to FIG. 1 at a fourth point in time.

Furthermore, the apparatus includes a rolling-up apparatus 16 which rolls up the web-type padding material 14 to form a coil-like padding product 18 (FIG. 2-4). For this purpose, the rolling-up apparatus 16 first has a roller conveyor 20 which is arranged substantially horizontally and which guides the web-type padding material 14 from the supply device 12 to an inlet 22 of a rolling-up space, which is mentioned below in more detail and is not yet present in FIG. 1, as is indicated by an arrow 23. A labeling device 24 is arranged above the roller conveyor 20, the function of which will be addressed in greater detail below. Furthermore, a clockwise-driven roller wheel 26 is arranged above the roller conveyor 20 immediately before the inlet 22, which roller wheel interacts with the web-type padding material 14 in a manner which is also still to be represented.

The rolling-up apparatus 16 comprises a flexible delimiting means 28 which is present in the form of a continuous strip. This continuous strip is presently made from a fabric having a plastics coating and is designed as a planar, flat strip material. The continuous strip 28 extends around a plurality of deflecting means which are presently designed as rotatably mounted rollers 30-46. In a very simple embodiment, the deflecting means could also be designed as rigid cylinders which are coated with a low-friction surface.

The above-mentioned inlet 22 is formed between the two rollers 30 and 32 adjacent to the roller conveyor 20. The roller 32 is arranged on a slide 48, indicated by a dash-dotted box, which is horizontally movable on a rail device 50, also indicated by a dash-dotted line. For this purpose, the slide 48 has a drive which is not shown here. The drive can be implemented for example by a revolving chain which is driven by an electric motor by means of a pinion. This is not shown, however. In this way, as will also be shown below, an opening extent of the inlet 22 can be increased in order to remove the coil-like padding product 18 from the rolling-up space, which, as already said, will be described in detail below and which does not yet exist at the point in time of the method shown in FIG. 1. Furthermore, a plurality of rollers 51 is arranged on the slide 48, by means of which a horizontal support plane is formed, similar to the roller conveyor 20.

The continuous strip 28 is held under a certain tension by one of the deflecting means, specifically the roller 38, being tensible. For this purpose, this roller 38 is guided in the vertical direction by a linear guide on a slide, although neither the linear guide nor the slide are shown in the drawings. A weight 52 is used as the pretensioning device.

Finally, a clockwise-driven drive roller 54 is arranged near the roller 42, which drive roller is also pushed against the roller 42 under a certain pretension from the continuous strip 28 side. The drive roller 54 is connected to a drive device (also not shown), for example an electric motor. The continuous strip 28 can be moved counterclockwise in the embodiment shown in FIG. 1-4 by the drive roller 54, as indicated by an arrow 56. The flexible delimiting means 28 or the continuous strip 28 are thus movable in a rolling-up direction. In this respect, the roller 42 forms a drive which drives the continuous strip 28.

The apparatus 10 operates as follows: the web-type padding material is ejected from the supply device 12 onto the roller conveyor 20 and is ultimately collected by the roller wheel 26. This state is shown in FIG. 1.

Later, the web-type padding material 14 is guided by the roller wheel 26 in the feed direction indicated by the arrow 23 through the inlet 22 formed between the two rollers 30 and 32, as a result of which the continuous strip 28 moving according to the arrow 56 is pushed in to the left in the feed direction indicated by the arrow 23 in FIG. 2. The speed of movement of the continuous strip 28 along the arrow 56 is adjusted to the conveying speed of the web-type padding material 14 along the arrow 23 in such a way, and the pretension by the weight 52 is selected in such a way, that a front end 58 of the web-type padding material 14 is initially pushed inwards relatively straight and is then deflected upwards along a curve due to the pretension of the continuous strip 28 and the friction between the continuous strip 28 and the web-type padding material 14.

The deflection occurs by the continuous strip 28 pushed in behind the inlet 22 then beginning to form a curved delimiting wall 60 of a rolling-up space 62, which wall guides the web-type padding material 14 which enters into the rolling-up space 62 now being formed through the inlet 22. In this way, the process of rolling up the initially web-type padding material 14 to form the coil-like padding product 18 begins.

The fact that the continuous strip 28 is pushed inwards and thus forms the curved delimiting wall 60 of the rolling-up space 62 shortens the length of the continuous strip 28 available for circulating around the rollers 30-46. This is compensated for by moving the roller 38 upwards along the vertical guide in the direction of an arrow 64. This state is shown in FIGS. 2 and 3.

It can also be seen from these figures that the extent of the rolling-up space 62 changes in the course of the rolling-up process by the extent becoming greater, so as to correspond to the diameter of the coil-like padding product 18 which increases during the rolling-up process. It can also be seen from FIGS. 2 and 3 that the rolling-up space 62, in the side view shown there, has a generally substantially circular cross section.

FIG. 3 also shows the preparation for completing the production of the coil-like padding product 18: the web-type padding material 14 supplied by the supply device 12 is actually not continuous, but has a rear end 66. If corresponding sensors (not shown in the drawings) detect that this rear end 66 is passing underneath the labeling device 24, an adhesive dot 68 that is adhesive on both sides is dispensed from the labeling device 24 onto the web-type padding material 14 just before the rear end 66 thereof, corresponding to the arrow 70 in FIG. 3. In the further course of the rolling-up process and the continual movement of the continuous strip 28, the rear end 66 of the web-type padding material 14 having the adhesive dot 68 that is adhesive on both sides also reaches the rolling-up space 62, as a result of which the rear end 66 is glued to the already rolled-up part of the coil-like padding product 18. This is shown in FIG. 4.

Also shown in FIG. 4 is the removal or ejection of the finished coil-like padding product 18 from the rolling-up apparatus 16: firstly, the movement of the continuous strip 28 is stopped by stopping the drive roller 54. Then, in FIG. 4, the slide 48 having the roller 32 and the plurality of rollers 51 is moved by motor to the left (arrow 71). The thus freed length of the continuous strip 28 is compensated for by the tensible roller 38 being moved back down along the linear guide due to the weight 52 present there. In this way, the continuous strip 28 remains under a certain tension. At the same time, by means of the movement of the slide 48 together with the roller 32, the opening extent of the inlet 22 is greatly increased. The finished coil-like padding product 18 now falls downwards along the arrow 72 due to gravity and is thus removed from the rolling-up apparatus 16. In the process, the rolling-up space 62 ceases to exist and is therefore "destroyed".

Thereafter, the slide 48 is again moved back to the right into the starting position shown in FIG. 1, so that the production of a new coil-like padding product 18 can begin.

It is clearly evident that the diameter of the coil-like padding product 18 depends on the length between the front end 58 and the rear end 66 of the web-type padding material 14.

The invention claimed is:

1. Apparatus for supplying a coil-like padding product for packaging purposes, comprising a supply device for supplying a web-type padding material and a rolling-up apparatus which rolls up the web-type padding material to form the coil-like padding product, wherein the rolling-up apparatus has no reel and instead comprises a flexible delimiting means present in the form of a continuous strip which can form an at least partially curved unitary delimiting wall of an at least temporarily present rolling-up space, of which the extent is preferably alterable and which has an inlet for the web-type padding material through which the web-type padding material can enter into the rolling-up space, the web-type padding material being guided by the at least partially curved delimiting wall, which results in the formation of the coil-like padding product, said inlet being formed between two rollers, one of which being arranged on a slide which is movable.

2. Apparatus according to claim 1, wherein the flexible delimiting means is movable in a rolling-up direction.

3. Apparatus according to claim 1, wherein the flexible delimiting means is made from an elastic material.

4. Apparatus according to claim 1, wherein the flexible delimiting means comprises a strip material and/or a chain-like structure.

5. Apparatus according to claim 1, wherein the rolling-up space, when viewed from the side, has a generally substantially circular cross section.

6. Apparatus according to claim 1, wherein it further comprises: a continuous strip which extends around a plurality of deflecting means, at least one of which is tensible, such that it holds the continuous strip at least temporarily under tension; and a drive which drives the continuous strip in one direction; the inlet into the rolling-up space being formed between two deflecting means such that, during operation, the web-type padding material is guided through said inlet transversely to the continuous strip, thus in a feed direction of the web-type padding material, and as a result the continuous strip is pushed in in the feed direction of the web-type padding material, and the delimiting means which forms a delimiting wall of the rolling-up space is formed by the pushed-in continuous strip.

7. Apparatus according to claim 6, wherein at least one of the deflecting means, preferably all the deflecting means, comprises or comprise a rotatably mounted roller.

8. Apparatus according to claim 6, wherein one of the two deflecting means forming the inlet into the rolling-up space is displaceably mounted such that an opening extent of the inlet can be increased in order to remove the coil-like padding product.

9. Apparatus according to claim 6, wherein the tensible deflecting means is guided linearly and comprises a pretensioning device in the form of a spring or a weight.

10. Apparatus according to claim 1, wherein the rolling-up space can be opened and/or destroyed in order to remove the coil-like padding product.

11. Apparatus for supplying a coil-like padding product for packaging purposes, comprising a supply device for supplying a web-type padding material and a rolling-up apparatus which rolls up the web-type padding material to form the coil-like padding product, wherein the rolling-up apparatus has no reel and instead comprises a flexible delimiting means present in the form of a continuous strip which can form an at least partially curved unitary delimiting wall of a rolling-up space, which is temporarily present in this respect that the rolling-up space first begins to be formed when the web-type padding material meets the continuous strip and pushes said strip in, the extent of the rolling-up space being alterable, the rolling-up space having an inlet for the web-type padding material through which the web-type padding material can enter into the rolling-up space, the web-type padding material being guided by the at least partially curved delimiting wall, which results in the formation of the coil-like padding product, said inlet being formed between two rollers, one of which being arranged on a slide which is movable.

12. Apparatus for supplying a coil-like padding product for packaging purposes, comprising a supply device for supplying a web-type padding material and a rolling-up apparatus which rolls up the web-type padding material to form the coil-like padding product, wherein the rolling-up apparatus has no reel and instead comprises a flexible delimiting means present in the form of a continuous strip which can form an at least partially curved unitary delimiting wall of an at least temporarily present rolling-up space, of which the extent is preferably alterable and which has an inlet for the web-type padding material through which the web-type padding material can enter into the rolling-up space, the web-type padding material being guided by the at least partially curved delimiting wall, which results in the formation of the coil-like padding product, said inlet being formed between two rollers, one of which being arranged on a slide which is horizontally movable.

13. Apparatus for supplying a coil-like padding product for packaging purposes, comprising a supply device for supplying a web-type padding material and a rolling-up apparatus which rolls up the web-type padding material to form the coil-like padding product, wherein the rolling-up apparatus has no reel and instead comprises a flexible delimiting means present in the form of a continuous strip which can form an at least partially curved unitary delimiting wall of an at least temporarily present rolling-up space, of which the extent is preferably alterable and which has an inlet for the web-type padding material through which the web-type padding material can enter into the rolling-up space, the web-type padding material being guided by the at least partially curved delimiting wall, which results in the formation of the coil-like padding product, said inlet being formed between two rollers, one of which is mounted for translational movement in the feed direction of the web-type padding material.

* * * * *